US008646396B2

(12) United States Patent
Shanley

(10) Patent No.: US 8,646,396 B2
(45) Date of Patent: Feb. 11, 2014

(54) TUFTING MACHINE FOR CREATING A CUT PILE CARPET WITH TWO DIFFERENT PILE HEIGHTS

(75) Inventor: Frank Shanley, Blackburn (GB)

(73) Assignee: Spencer Wright Induatries, Inc., Chattanooga, TN (US)

( * ) Notice: Subject to any disclaimer, the term of this patent is extended or adjusted under 35 U.S.C. 154(b) by 185 days.

(21) Appl. No.: 13/253,517

(22) Filed: Oct. 5, 2011

(65) Prior Publication Data

US 2012/0097082 A1 Apr. 26, 2012

(30) Foreign Application Priority Data

Oct. 22, 2010 (GB) ..... 1017940.6

(51) Int. Cl.
*D05C 15/22* (2006.01)

(52) U.S. Cl.
USPC ..... 112/80.54

(58) Field of Classification Search
USPC ..... 112/80.54, 80.55, 80.56, 80.58, 80.59, 112/80.6, 80.71, 80.32, 80.42
See application file for complete search history.

(56) References Cited

U.S. PATENT DOCUMENTS

| | | | | |
|---|---|---|---|---|
| 1,909,530 | A * | 5/1933 | Gladish | 112/80.56 |
| 4,266,491 | A | 5/1981 | Prichard | |
| 4,285,286 | A * | 8/1981 | Hash | 112/80.53 |
| 5,042,405 | A * | 8/1991 | Bradley et al. | 112/80.7 |
| 6,895,877 | B1 * | 5/2005 | Weiner | 112/80.7 |
| 7,634,326 | B2 * | 12/2009 | Christman et al. | 700/131 |
| 8,082,862 | B2 * | 12/2011 | Hillenbrand et al. | 112/80.59 |

FOREIGN PATENT DOCUMENTS

| | | | |
|---|---|---|---|
| GB | 1318222 | A | 5/1973 |
| JP | 02112462 | A | 4/1990 |
| JP | 05059656 | A | 3/1993 |

* cited by examiner

*Primary Examiner* — Tejash Patel
(74) *Attorney, Agent, or Firm* — Smith, Gambrell & Russell

(57) ABSTRACT

A tufting machine for creating cut pile carpet with two different pile heights. A knife (20) associated with a respective hook assembly (1), and is reciprocally mounted and inclined with respect thereto. Each hook assembly has upper (6) and lower (7) hooks each having a cutting edge (8, 9) at the lower edge and means (10) for selectively directing the yarn onto one of the upper and lower hooks. The knives (20) each have a single cutting edge (21) arranged to co-operate with both the upper (6) and lower (7) hooks to cut each loop of yarn seized by a respective hook assembly with a scissor action. Relief (22) is provided between the knife and the lower hook allowing the knife to clear the lower hook (7) when the knife cutting edge (21) approaches the upper hook cutting edge (8).

19 Claims, 12 Drawing Sheets

TUFTING MACHINE FOR CREATING A CUT PILE CARPET WITH TWO DIFFERENT PILE HEIGHTS

This application claims priority to Great Britain application no. 1017940.6, filed Oct. 22, 2010, which is incorporated herein by reference.

The present invention relates to a tufting machine for creating a cut pile carpet with two different pile heights.

In the past, attempts have been made to produce a tufting machine for creating a cut pile carpet with two different pile heights in the same line. This involves producing a hook assembly having upper and lower hooks, and a sprung clip which initially retains all loops of the yarn on the lower hook. The tension in the yarn is controlled so as to selectively pull certain loops of yarn past the clip and onto the upper hooks, whereupon a knife passes both the lower and upper hooks to cut the yarn on whichever hook it is retained. The knife is typically mounted at a dual angle, e.g. with a pressure angle of 8° to 10° and a scissor angle of about 2° to 4° with respect to the hook. This means that during the knife's upward movement, the side pressure caused by the pressure angle tends to cause the cutting edge of the knife to be forced into the cutting edge the hook with the scissor angle creating a scissor action between the two cutting edges. The knife pressure and the scissor angle effectively create a pressurised contact between the cutting edges which moves progressively across the cutting edges as the knife moves further with respect to the hook. This ensures that pressure is maintained between the two cutting edges in order to provide a clean cut of the yarn.

The difficulty with a hook assembly which can create two pile heights is that the lower hook restricts the knife scissor angle at the upper hook, thereby reducing the pressure between the cutting edge of the knife and the cutting edge of the upper hook which is detrimental to the cutting operation. This would therefore require a considerable distance between the upper and lower hooks so as to allow the knife sufficient space to flex back towards the upper hook.

Another approach to this problem is disclosed in GB 1 318 222, U.S. Pat. No. 4,266,491 and JP 5059656. These disclose the idea of having two cutting edges, either using two separate knives or having two cutting edges on a single knife, with one cutting edge co-operating with each of the upper and lower hooks. Although this solves the problem of a single knife cutting edge referred to above in that this avoids the lower hook restricting the scissor angle at the upper hook, it does significantly increase the complexity of the knife thereby increasing the cost, and also increasing the minimum pitch of the machine which can be obtained with such a design. In addition, as the knife is in pressurised contact with two regions of the hook assembly throughout the cutting operation, the frictional engagement between the knives and the hook is approximately doubled, thereby increasing the power consumption of the machine and also the generation of unwanted heat.

According to the present invention, there is provided a tufting machine for creating a cut pile carpet with two different pile heights, the machine comprising a housing; a needle bar which is reciprocally movable within the housing and on which a plurality of needles are mounted, whereby, in use, as a web of backing medium is fed through the machine in a first direction, the needles reciprocate towards and away from the web in a second direction; a respective hook assembly associated with each of the needles; the hook assembly being reciprocally mounted so as to grab each loop of yarn as it is created by a respective needle; and a knife associated with each hook assembly and having a cutting edge, the knives being reciprocally mounted and inclined with respect to a respective hook assembly so as to pressurise the knife against the hook assembly; wherein at least one hook assembly is provided with upper and lower hooks each having a cutting edge at the lower edge and a means for selectively directing the yarn onto one of the upper and lower hooks; the respective knife having a single cutting edge arranged to co-operate with both the upper and lower hooks to cut each loop of yarn seized by a respective hook assembly with a scissor action; a relief being provided between the knife and the lower hook allowing the knife to clear the lower hook when the cutting edge of the knife approaches the cutting edge of the upper hook.

With this arrangement, the relief ensures that the lower hook does not contact the knife once the cutting edge of the knife has passed the lower hook so that the scissor angle is restored as the cutting edge of the knife approaches the cutting edge of the upper hook. This means that the cutting edges of the upper and lower yarn hooks can be brought much closer together allowing a carpet to be created with two different pile heights which are close together in height.

The relief may be at least partially provided by the cutting edges of upper and lower hooks being off-set in a direction substantially transverse to the first and second directions so that the cutting edge of the upper hook projects on the knife side beyond the cutting edge of the lower hook.

The upper and lower hooks could be part of a single component. However, preferably, they are mounted separately into the hook assembly. This ensures that it is easier to machine the relatively complex shapes required of the two hooks. Also, preferably, the support of the upper and lower hooks is a two-part structure with the upper hook being mounted to a first part and the lower hook being mounted to a second part. Again, this improves assembly where the upper hooks and the lower hooks can be mounted separately without interference from the other set of hooks. This also facilitates re-grinding of the hook, as again, this provides relatively unrestricted access to the hooks.

Preferably, the interface between the upper and lower parts has a stepped configuration such that the lower part has a first mating face with a generally downwardly facing component and the upper part has a corresponding mating face with a generally upwardly facing component, whereby the mating faces prevent elevational separation of the two parts. By providing this stepped configuration, separation of the upper and lower hooks is prevented in use.

Alternatively or additionally, the relief may be at least partially provided in the side of the knife adjacent to the hook. The relief is preferably in the form of a recess extending across the entire width of the knife adjacent to and below the cutting edge.

In order to ensure that the yarn from the lower hook is retained as effectively as possible on the upper hook, the upper hook preferably has a tip which extends beyond the lower hook and extends downwardly to a location which is generally co-planar with the lower edge of the lower hook.

Preferably, the tip of the upper hook is thinner than the remainder of the upper hook with the thinning being applied to the surface on the knife side so that the tip of the upper hook is more closely aligned with the tip of the lower hook. This provides a more reliable transfer of the yarn from the lower to the upper hook.

In order to assist in creating the relief, the lower hook preferably has a chamfer on its upper edge on the knife side.

Preferably, a chamfer is provided behind the cutting edge on the region of the upper hook against which the knife abuts, in use, to allow the knife to transition from the lower hook to the upper hook. The depth of the chamfer in the second direction preferably increases away from the tip of the hook to provide a smooth transition.

Preferably, the knife has a reduced thickness at least along the section which, in use, would pass the hook assembly. This allows adjacent assemblies to be closer together as the knife requires less space to pass.

The means for selectively directing the yarn onto one of the two upper and lower hooks is most simply provided by a means for controlling the tension in the yarn, such that increasing the tension pulls a loop of yarn off of the lower hook and onto the upper hook. However, preferably, in addition to the means to control the yarn tension, a resilient clip is provided which cooperates with the lower hook to retain the loops of yarn on the lower hook until the tension is sufficiently increased so as to pull the yarn past the clip which deforms resiliently allowing the yarn onto the upper hook.

The present assembly also extends to a hook assembly for the above tufting machine, the hook comprising upper and lower hooks each having a cutting edge at the lower edge and a means for selectively directing the yarn onto one of the upper and lower hooks, the cutting edges of upper and lower hooks being off-set with respect to one another so that the cutting edge of the upper hook projects beyond the cutting edge of the lower hook.

The present invention also extends to a knife for the above machine, the knife having a single cutting edge, the cutting edge being at one end, and a recess extending across the entire width of one side of the knife adjacent to and below the cutting edge.

Examples of the present invention will now be described with reference to the accompanying drawings, in which.

Figure 1A:
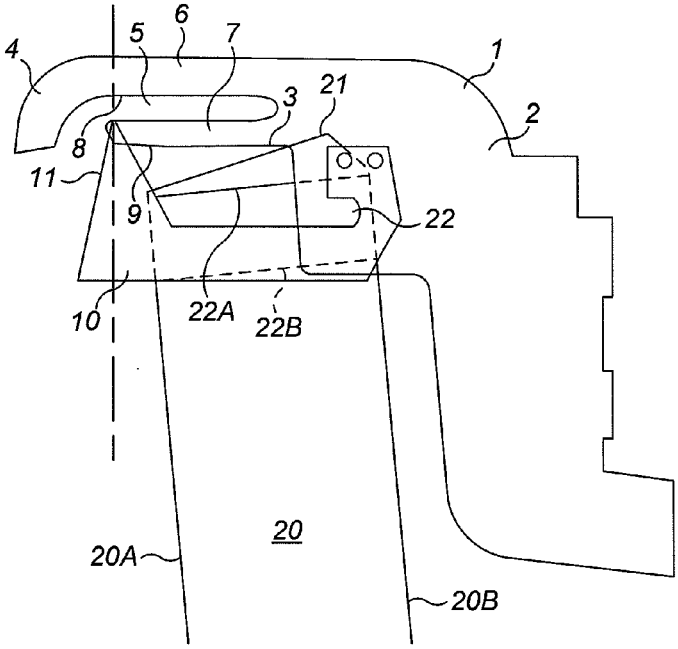
FIG. 1A is a front view of a first example of a hook and knife with the knife in its lowermost position.

Most aspects of the tufting machine including the needles and the driving mechanisms for the needles are conventional and will not be described here.

A hook assembly 1 is attached to a hook bar via its shank 2. A throat 3 extends from the shank 2 and terminates at a bill 4. A recess 5 is machined into the bill and extends from the bill along the throat towards the shank so as to define upper 6 and lower 7 hooks. The bottom edges of these two hooks 6, 7 are sharpened so as to provide upper 8 and lower 9 cutting edges.

A spring clip 10 is attached to the shank 2 of the hook 1 and extends towards the bill 4 terminating in an upward projection 11. The clip is resilient, such that the resilience of the material causes the upwardly projecting portion 11 to bear against the lower hook 7. The upper hook 6 extends for the full distance of the bill 4, namely well beyond the lower yarn engaging portion.

In use, the hook assembly 1 is arranged to enter a loop of yarn which has just been created by a needle so that the loop passes between the clip 10 and lower hook 7 with the clip 10 deforming resiliently to allow the loop to pass. Then, if the tension applied to the yarn is high, the loop is pulled back past the upward projection of the loop 11 and is caught by the bill 4 and forced round towards the upper cutting edge 8. On the other hand, if less tension is applied to the yarn, it is simply retained by the clip 10 on the lower hook 7.

A knife 20 has a front edge 20A, a rear edge 20B and a cutting edge 21 at its uppermost surface. On every stroke, the knife is moved a sufficient distance such that it passes beyond the upper cutting edge 8 of the upper hook 6.

Figure 1C:
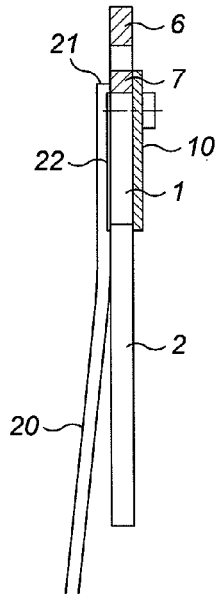
FIG. 1C is an end view of the hook and knife in the same position as in FIG. 1A with the front of the hook removed.
Figure 1B:
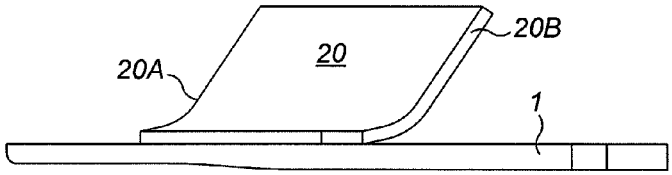
FIG. 1B is a top view of the hook and knife in the same position as in FIG. 1A.
Figure 2A:
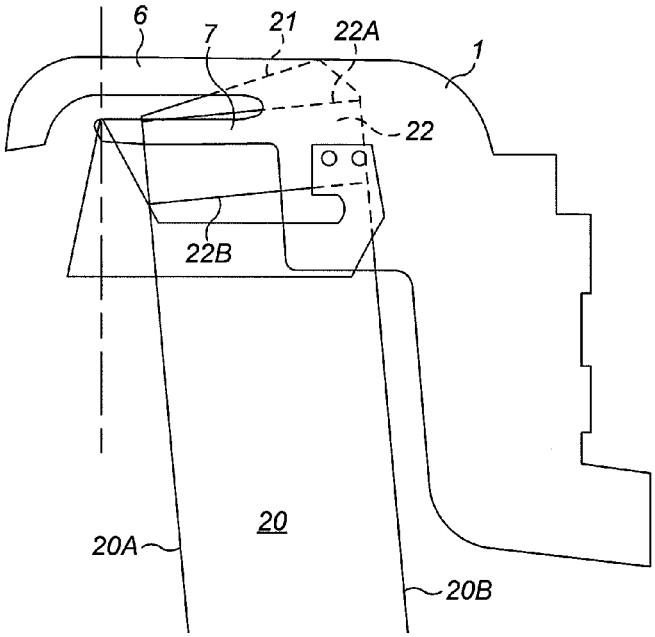
FIGS. 2A to 2C are views similar to FIGS. 1A to 1C respectively showing the knife in an intermediate position.

The knife 2 and hook assembly 1 are both substantially planar with the planes of the knife and hook being inclined at a scissor angle towards one another from the shank 2 of the hook towards the bill 4. The angle of incline is of the order of 2° to 4°. The knives are also mounted so that they are inclined to the vertical at a pressure angle of approximately 8° to 10° as shown, for example, in FIG. 1C. When the knives are mounted in a tufting machine, their mounted ends are moved towards the respective hook assemblies tending to bend each knife back against the face of the hook as shown, for example, in FIG. 1C. The knives and hook assemblies hence act with a scissor action between the cutting edge 21 of the knife and the lower cutting edge 9 of the lower hook 7. Thus, as the knife 20 travels upwardly, and is pressurised towards the hook assembly 1 by the pressure angle, the scissor angle causes pressure to be exerted between the cutting edges 9, 21 as the point of contact between the cutting edges, moves to the left until the cutting edge 21 has fully passed the lower cutting edge into a position between those shown in FIGS. 1A and 2A.

Figure 2C:
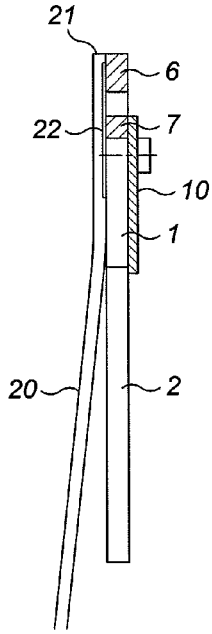
Figure 2B:
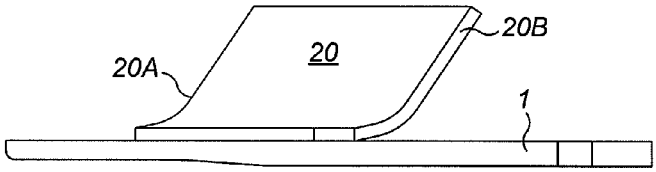
Figure 3A:
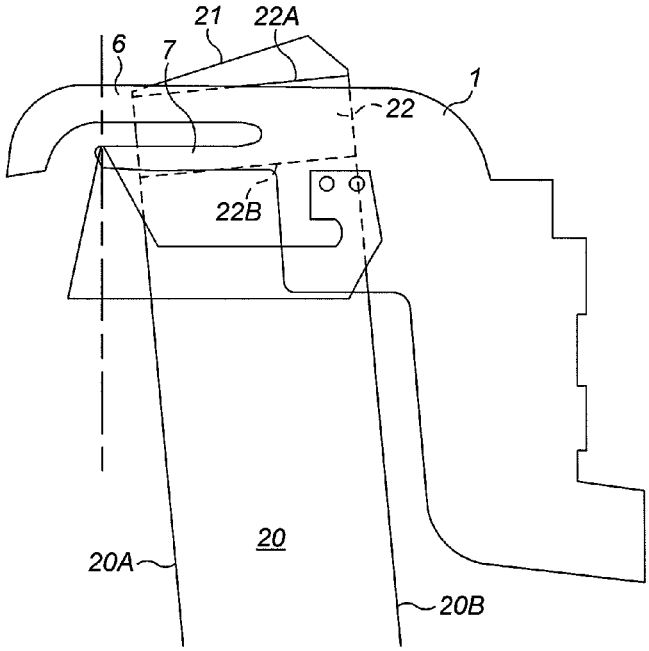
FIGS. 3A to 3C are views similar to FIGS. 1A to 1C respectively showing the knife in its uppermost position.
Figure 3C:
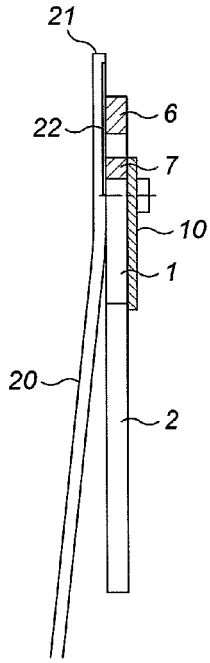
Figure 3B:
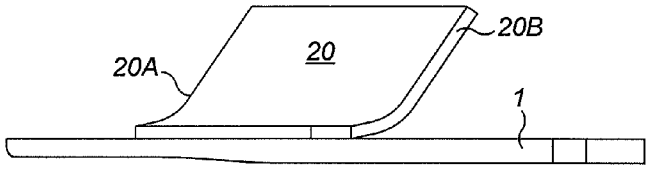
Figure 4:
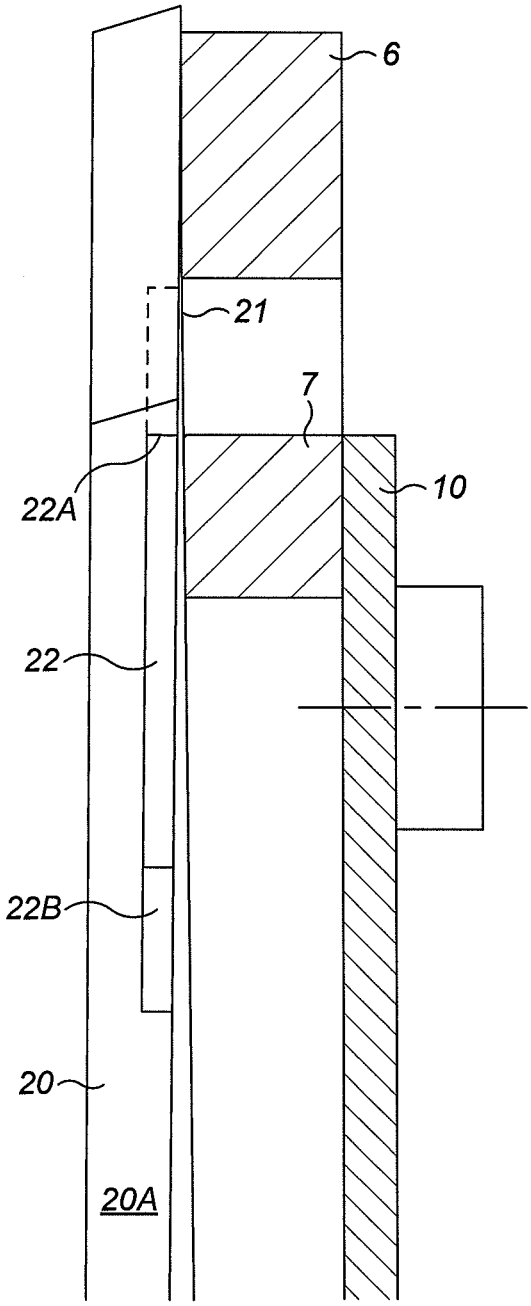
FIG. 4 shows a detail on an enlarged scale of a portion of the hook and knife as shown in FIG. 2C.

The knife is provided with a recess 22 which extends across the full width of the knife just below the cutting edge 21 and is bounded by upper 22A and lower 22B edges. The recess 22 is sized such that once the knife reaches the position shown in FIGS. 2A-2C where it is level with the lower hook 7, there is no longer contact between the lower hook and the knife as is apparent from FIG. 4. The pressure of the knife 20 against the hook assembly 1 generated by the pressure angle can thus cause the scissor angle to be restored without interference from the lower hook. Effectively, this is achieved by the pressure on the knife, and the fact that the recess 22 allows the front edge 20A of the knife the necessary freedom to be moved back slightly under the upper hook 6.

Continued upward movement of the knife causes the point of contact between the cutting edge 21 of the knife and the upper cutting edge 8 to move to the left while the scissor action is maintained by virtue of the incline between the hook and knife.

It will be appreciated that if the recess 22 were not provided in the knife, once the cutting edge 21 of the knife has passed the lower yarn engaging portion 7, it will effectively continue to move straight up as the lower yarn engaging portion is preventing the forward edge of the knife moving to a position under the upper hook 6 under its own resilience.

Figure 5A:
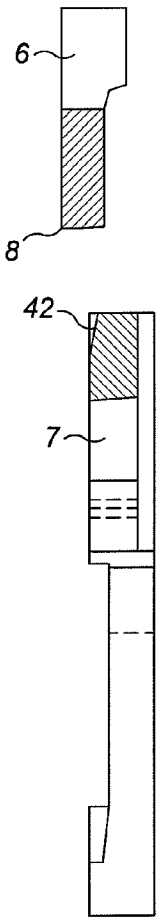
FIG. 5A is a cross-section through line A-A in FIG. 5.
Figure 5:
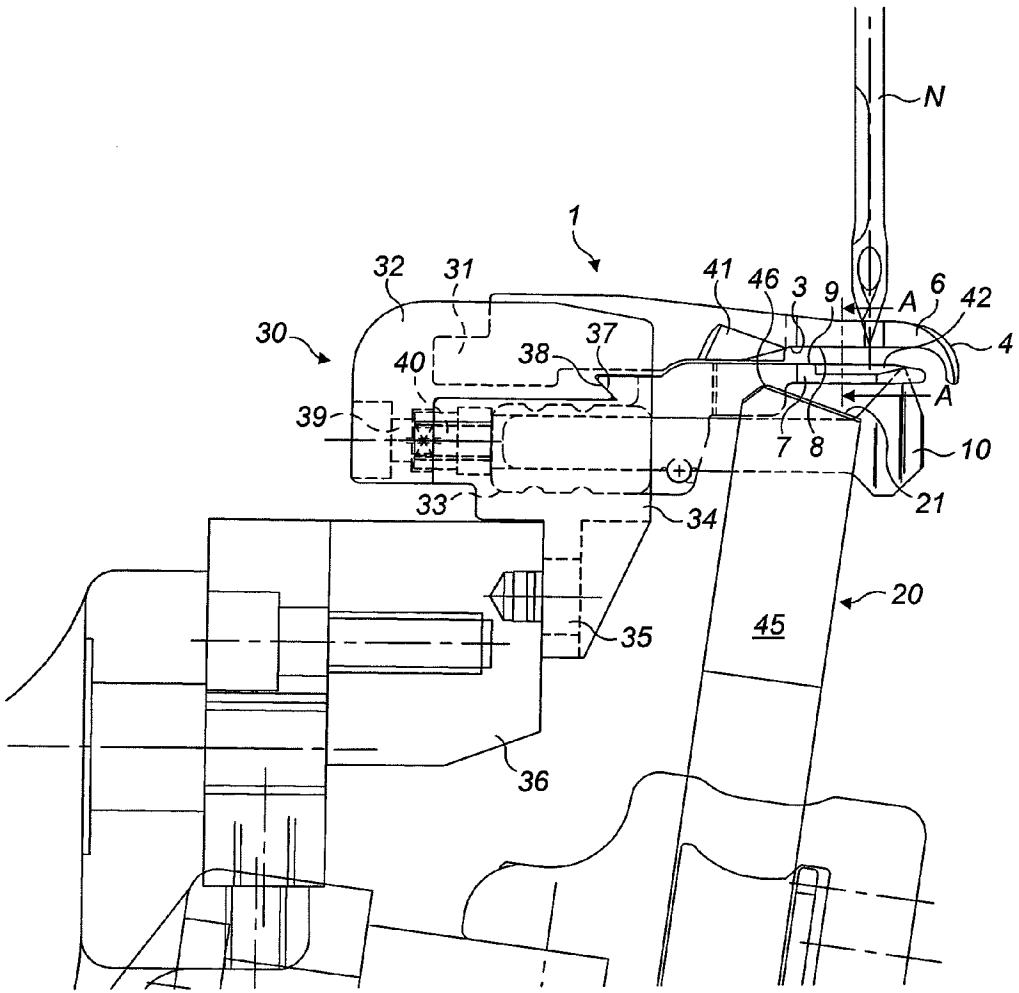
FIG. 5 is a front view of a second example of a hook and knife with the knife in its lowermost position.
Figure 6:
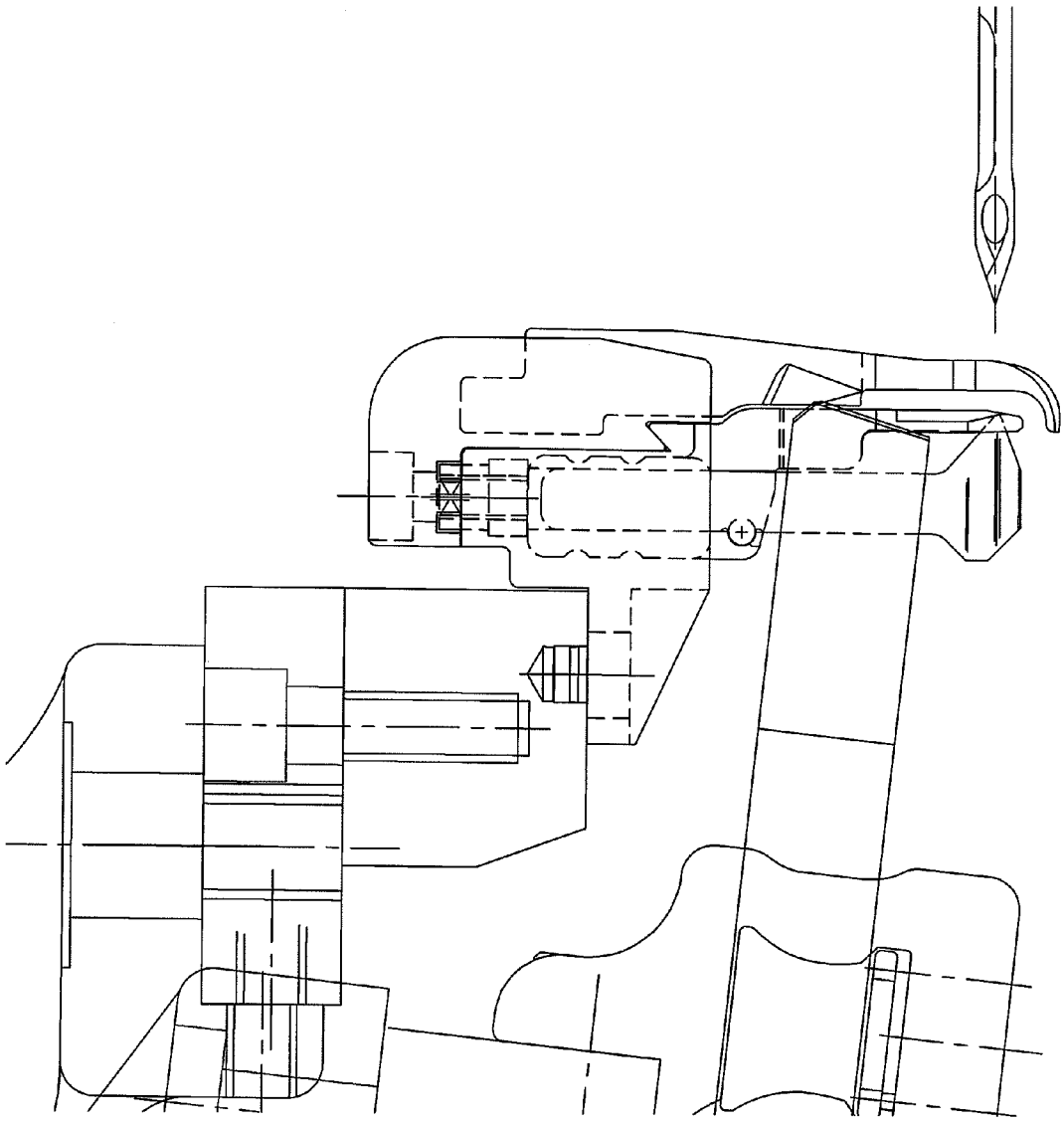
FIG. 6 is a view similar to FIG. 5 with the knife in an intermediate position.
Figure 7:
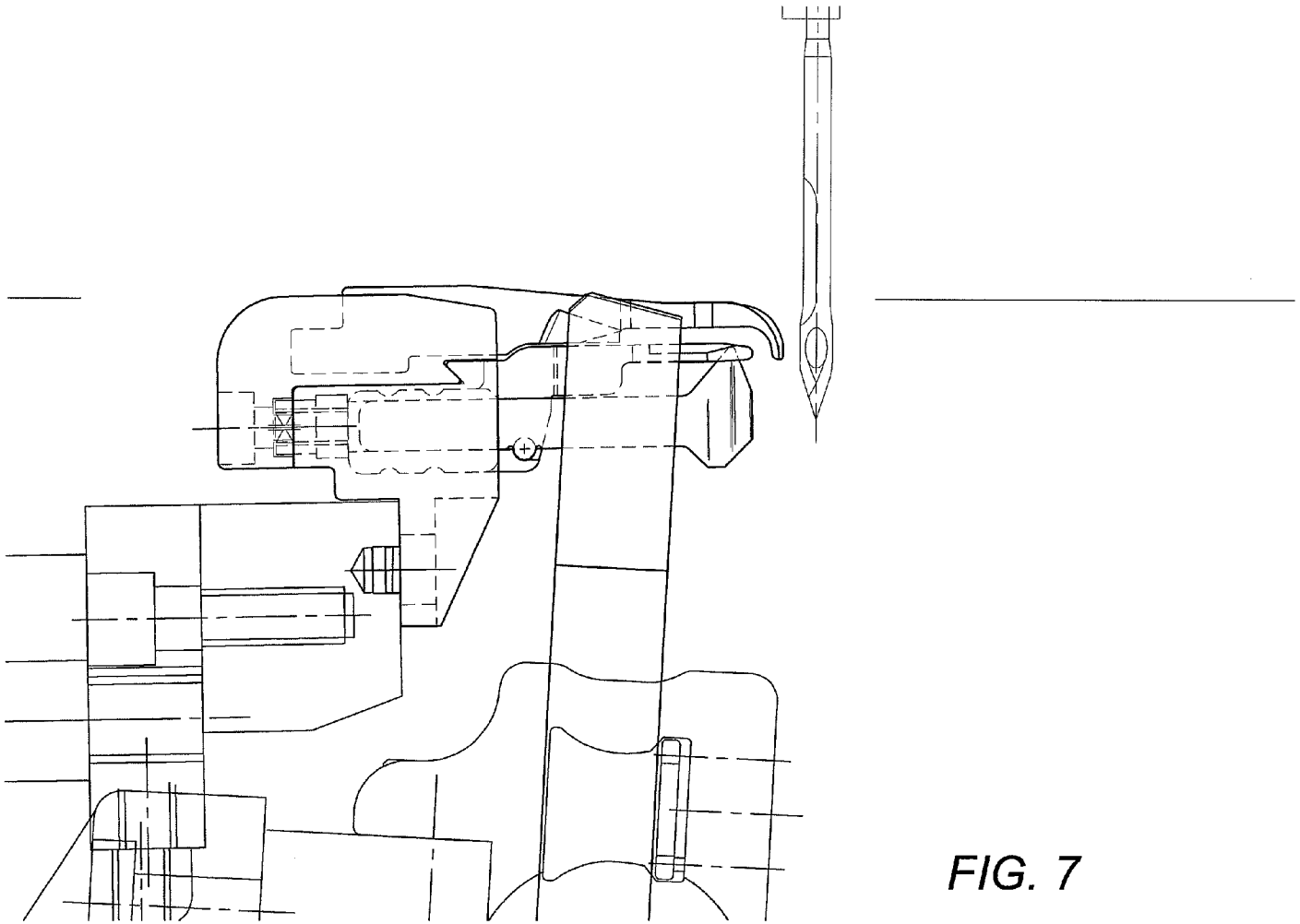
FIG. 7 is a view similar to FIGS. 5 and 6 with the knife in its uppermost position.

A second example of a hook assembly 1 and knife 20 is shown in FIGS. 5 to 7.

The fundamental difference between the two examples is that, whereas, in the first example, the relief between the knife and lower hook was provided by the recess 22, in the second example no recess is present. Instead, the relief is provided by the upper 6 and lower 7 hooks being off-set from one another as described below. Before describing this, some structural differences are first described below.

The most significant structural difference is that, rather than being formed from a single component with a recess machined to provide the two cutting edges, the hook assembly of the second example is provided by two separate components for the upper hook 6 and lower hook 7 which are mounted independently into the hook module 30. The upper hook 6 has a rear mounting portion 31 which is mounted to an upper hook module portion 32. The lower hook 7 has a rear mounting portion 33 mounted to a lower hook module portion 34. The clip 10 is also mounted to this lower hook module portion 34. The lower hook module portion 34 has an opening 35 via which it is bolted to a hook bar 36.

The interface between the upper hook module portion 32 and the lower hook module portion 34 has a stepped configuration. The upper hook module portion 32 has a generally upwardly inclined face 37 and the lower hook module portion 34 has a complimentary downwardly inclined face 38. These inclined faces resist elevational separation between the two module portions 32, 34. In order to assemble a module, the upper hooks 6 are mounted in upper hook module portion 32 in the lower hooks 7 and clips 10 are independently mounted in lower hook module portion 34. This allows the upper hooks 6 and lower hooks 7 to be easily mounted without interfering with one another.

Figure 8A:
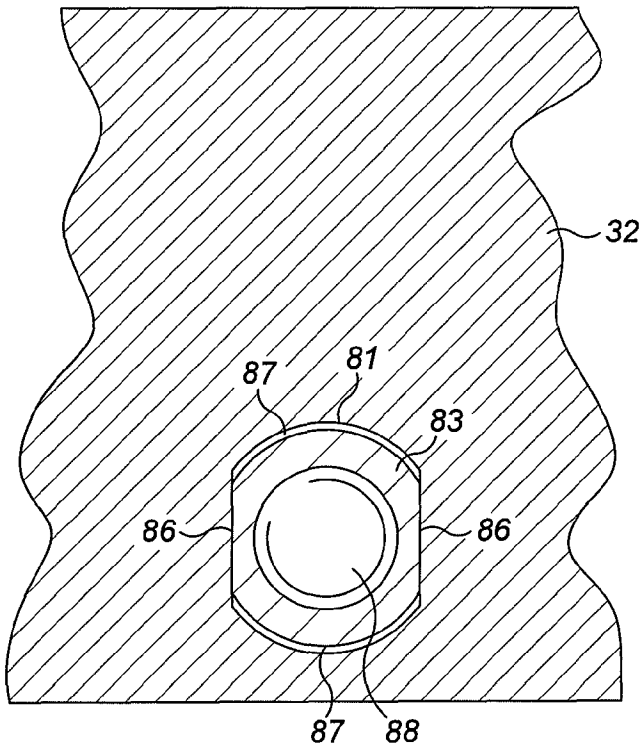
FIG. 8A is a cross-section through lines A-A in FIG. 8.
Figure 8:
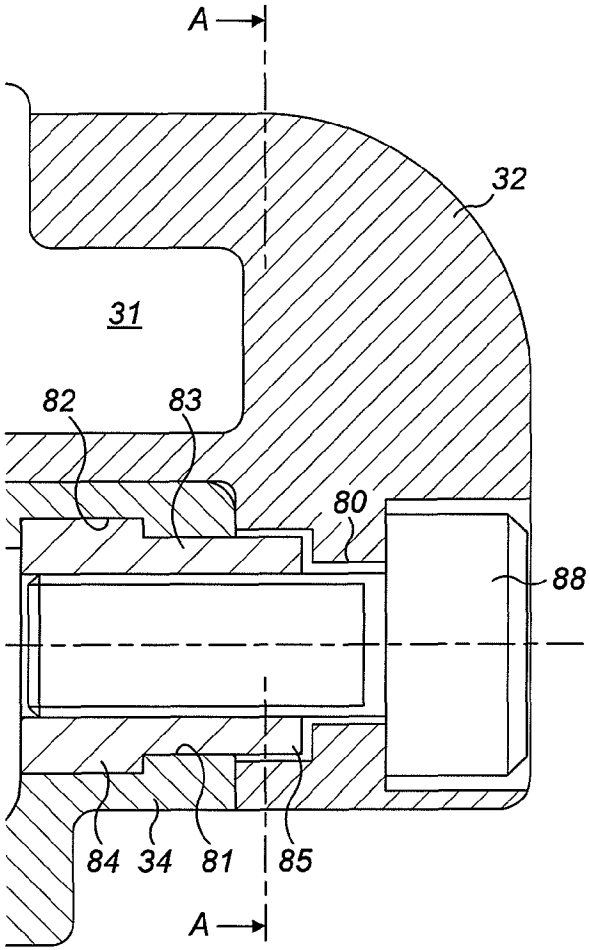
FIG. 8 is a cross-section showing a portion of FIG. 5 (but in the opposite sense) in greater detail.

Details of the bolted interface are shown in FIGS. 8 and 8A.

The module portions 32, 34 have respective aligned bores 80, 81. The bore 81 has a counter-sunk portion 82. A hollow pin 83 with a female screw thread is inserted into the module portion 34 prior to the assembly of the two module portions. This pin 33 has an enlarged head 84 which fits within the counter-sunk bore 82 and a shank 85 which is provided with a pair of flat lateral surfaces 86 which engage with corresponding flat surfaces in the bore 81. At the top and bottom of the shank 85 are vertical clearances 87. With the pin 83 in place, the two modules are brought together in the position shown in FIG. 8A and a bolt 88 is screwed into the hollow pin 83 to complete the connection.

The flat surfaces 86 ensure that the lateral alignment of the two modules is correct, while the inclined surfaces 37, 38 guarantee the correct vertical orientation. The clearances 87 ensure that the pin 83 is able to accommodate the variations in the vertical alignment caused by manufacturing tolerances.

The upper hook 6 is provided with a chamfer 41 immediately behind the throat 3. As can be seen at FIG. 5, the chamfer is deepest furthest from the throat, and tapers down to nothing at the throat. The purpose of this chamfer 41 is to guide the knife onto the upper cutting edge 8 as described in greater detail below. A second chamfer 41A adjacent to the throat provides additional relief for the knife.

The lower hook 7 is provided on its upper surface with a chamfer 42. This is provided so as not to unduly obstruct the knife as it progresses from the lower hook 7 to the upper hook 6.

As can be seen in FIG. 5A, the upper hook 6 is off-set with respect to the lower hook 7 with the upper hook 6 being closer to the knife side than the lower hook 7. In order to ensure that the hook assembly 1 enters the loop of yarn, the distal end of the upper hook 6 is thinner than the remainder of the upper hook as shown in FIG. 5C with the tip of the hook being inclined towards the plane of lower hook 7 so that the tips of the upper and lower hooks are substantially in the same plane to ensure that they can readily pick up a loop of yarn from the needle N.

Figure 5B:
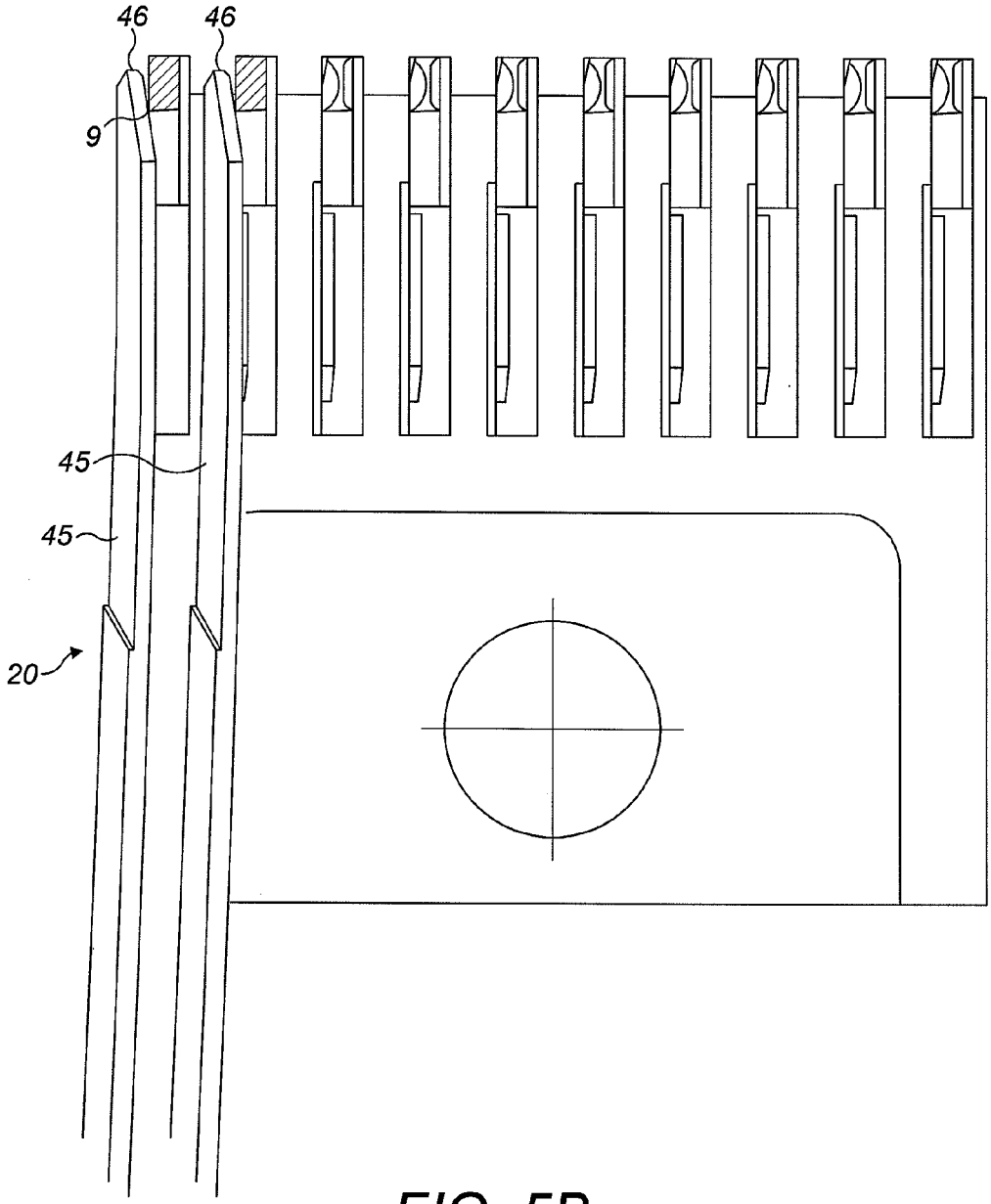
FIG. 5B is an end view showing a line of lower hooks (upper hooks not shown) with knives (only two of which are shown) in a position slightly raised from the position of FIG. 5.
Figure 5C:
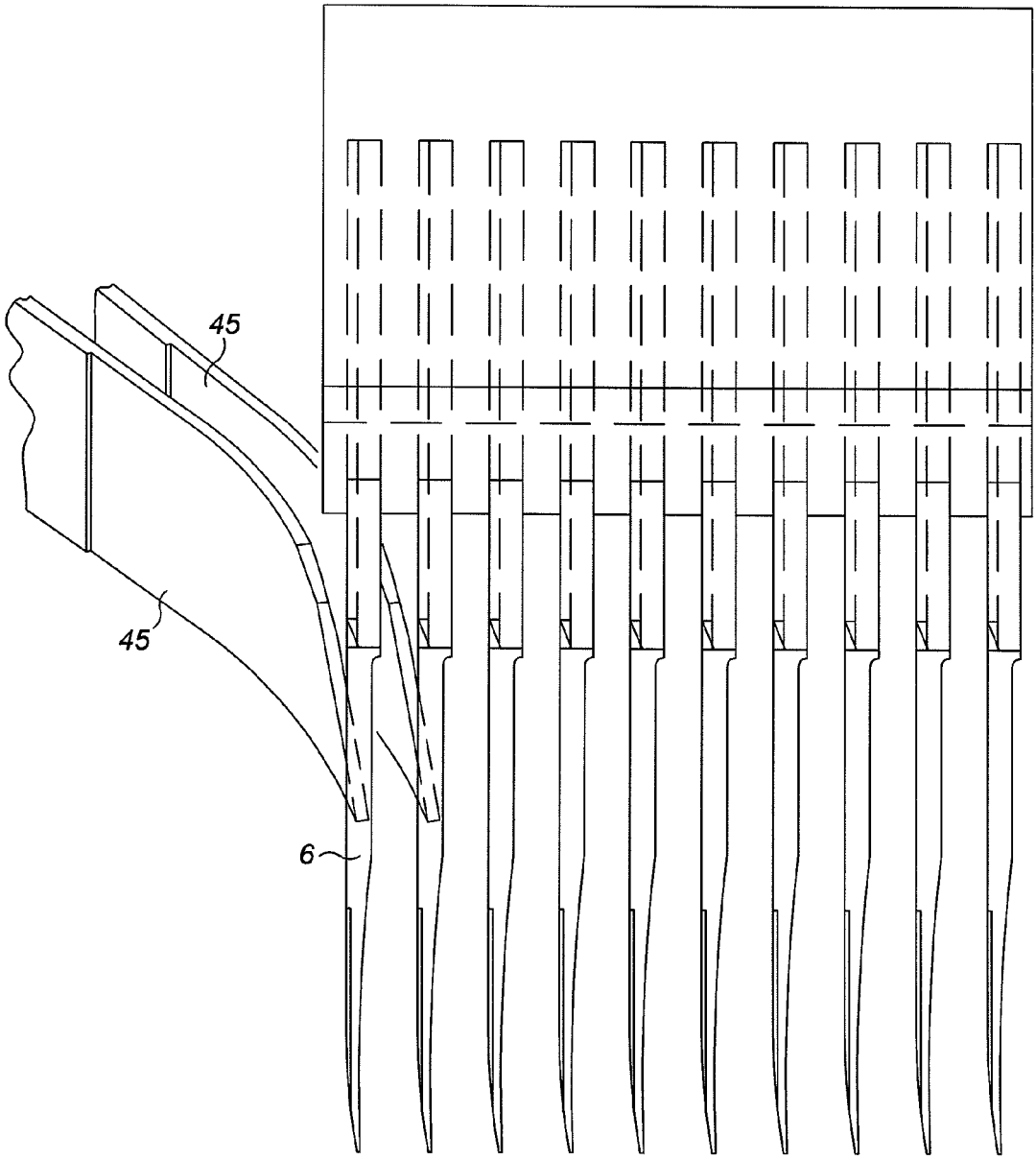
FIG. 5C is a top view corresponding to FIG. 5B.

As can be seen from FIG. 5B, the upper portion 45 of each knife 20 is thinner than the remainder of the knife. This means that the knife requires less clearance between adjacent hooks. Also, the tip 46 of the knife which abuts against the chamfer 41 is removed so that the knife presents a small triangular facet to the chamfer 41, rather than a sharp point.

The operation of the second example will now be described.

The hook picks up the yarn as described in relation to the first example, and the manner in which it is moved from the lower hook to the upper hook is as previously described.

Figure 7A:
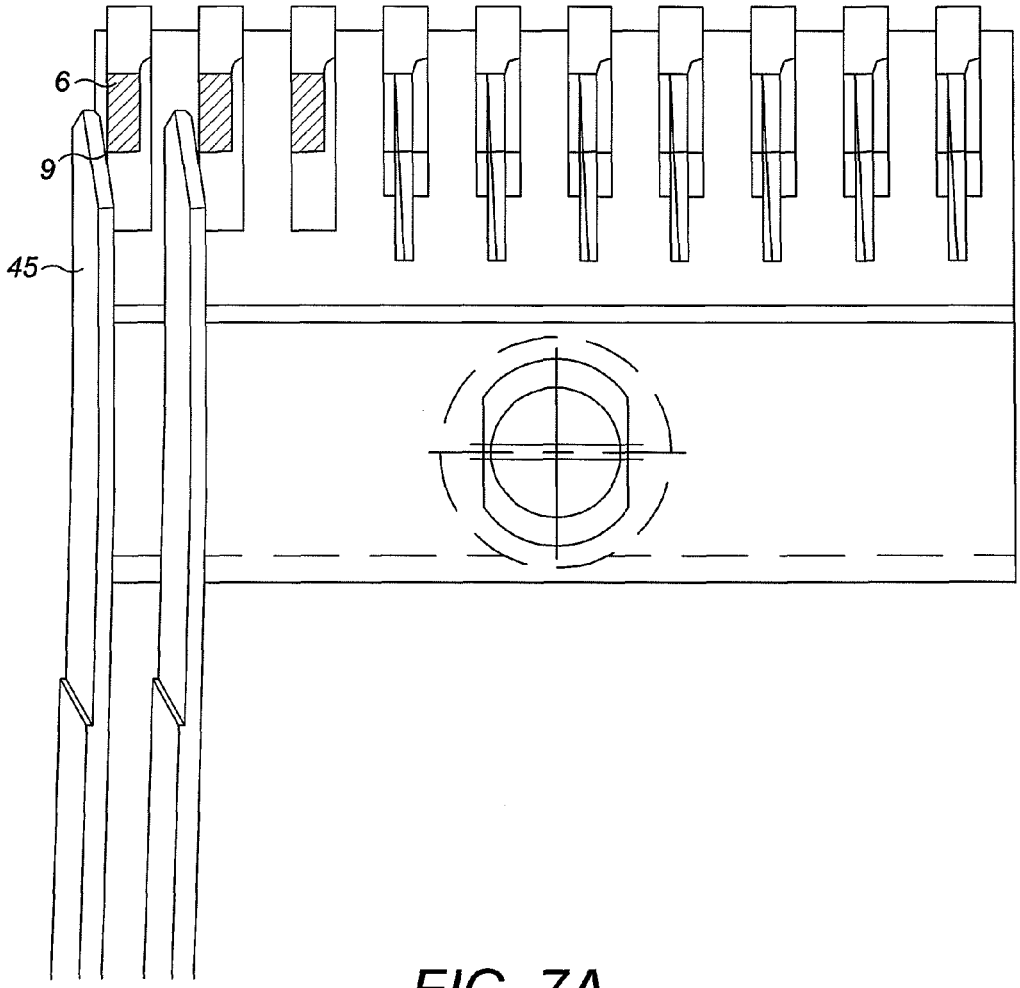
FIG. 7A is a view similar to FIG. 5B showing a line of upper hooks (lower hooks not shown) showing the knife in its uppermost position.
Figure 7B:
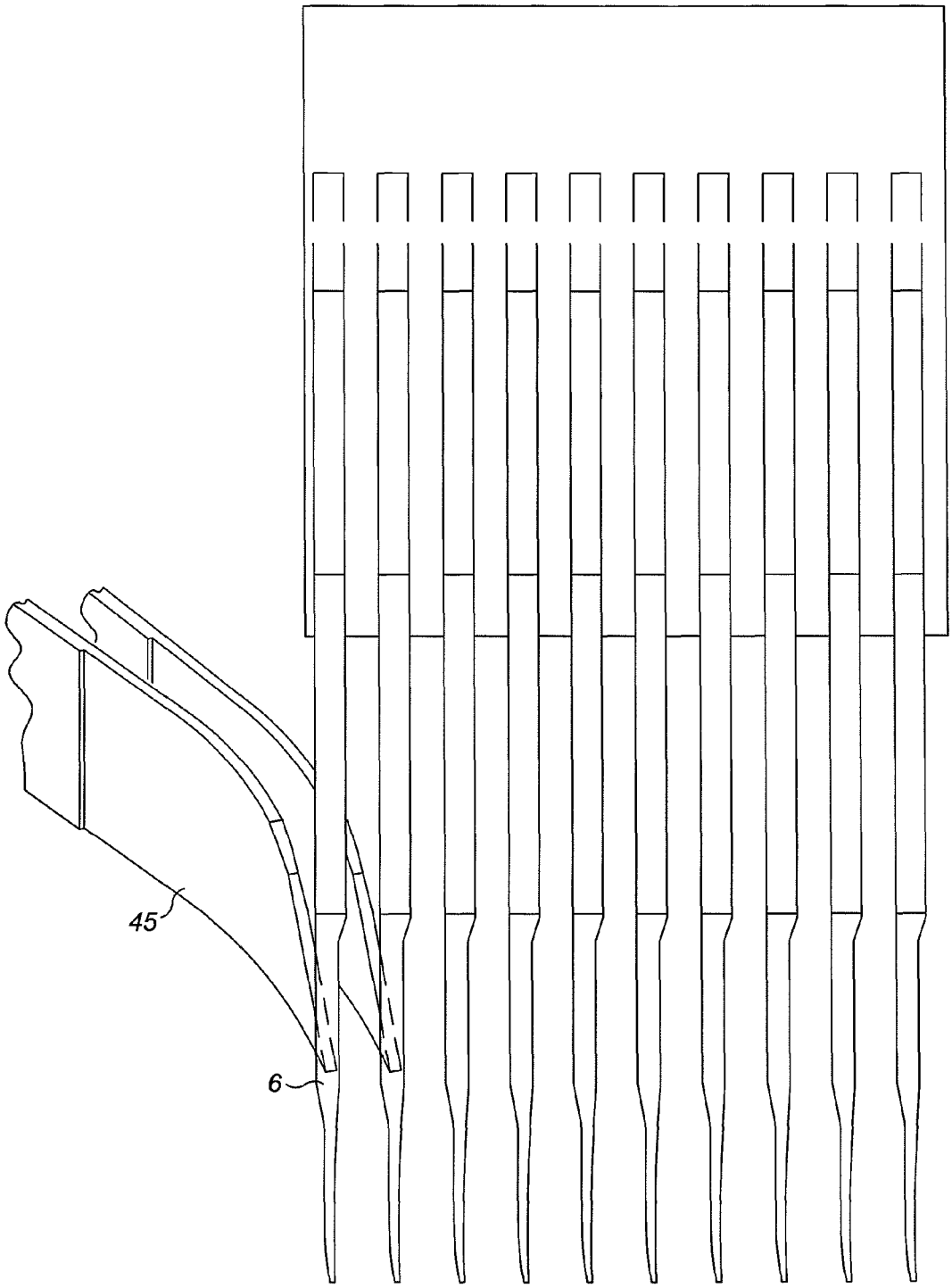
FIG. 7B is a view similar to FIG. 5C with the knives in the uppermost position (upper hooks only shown)

The knife 20 starts from the position shown in FIG. 5 and progresses to the slightly higher position shown in FIGS. 5B and 5C where the cutting edge of the knife engages with the cutting edge 9 of the lower hook 7 to cut the yarn if it is on the lower hook. The knife then progresses up to the position shown in FIG. 6 where it begins to encounter the chamfer 41. The chamfer forces the knife outwardly allowing the knife to be deflected back past the cutting edge 8 where it engages it with adequate pressure to form a scissor angle and cut the yarn as shown in FIG. 7A.

The invention claimed is:

1. A tufting machine for creating a cut pile carpet with two different pile heights, the machine comprising a housing;

a needle bar which is reciprocally movable within the housing and on which a plurality of needles are mounted, whereby, in use, as a web of backing medium is fed through the machine in a first direction, the plurality of needles reciprocate towards and away from the web in a second direction;

a respective hook assembly associated with each of the needles of said plurality of needles; each said hook assembly being reciprocally mounted so as to grab each loop of yarn as it is created by a respective needle; and a knife associated with each said hook assembly and having a cutting edge, the knives being reciprocally mounted and inclined with respect to said hook assemblies so as to pressurize the knife against said respective hook assembly; wherein at least one of said hook assemblies is provided with upper and lower hooks each having a cutting edge at a lower edge thereof and a means for selectively directing the yarn onto one of the upper and lower hooks;

each respective knife having a single cutting edge arranged to co-operate with both the upper and lower hooks to cut each loop of yarn seized by said at least one hook assembly with a scissor action whether the loop is on the upper or lower hook; a relief being provided between the knife and the lower hook allowing the knife to clear the lower hook when the cutting edge of the knife approaches the cutting edge of the upper hook.

2. A tufting machine according to claim 1, wherein the relief is at least partially provided by the cutting edges of upper and lower hooks being off-set in a direction substantially transverse to the first and second directions so that the cutting edge of the upper hook projects on the knife side beyond the cutting edge of the lower hook.

3. A tufting machine according to claim 2, wherein the upper and lower hooks are mounted separately into the hook assembly.

4. A tufting machine according to claim 3, wherein the support for the upper and lower hooks is a two-part structure with the upper hook being mounted to a first part and the lower hook being mounted to a second part.

5. A tufting machine according to claim 4, wherein the first and second parts have inter-engaging portions which align the two parts laterally with respect to one another.

6. A tufting machine according to claim 3, wherein the interface between the upper and lower parts has a stepped configuration such that the lower part has a first mating face with a generally downwardly facing component and the upper part has a corresponding mating face with a generally upwardly facing component, whereby the mating faces prevent elevational separation of the two parts.

7. A tufting machine according to claim 1 wherein the relief is at least partially provided in the side of the knife adjacent to the hook assembly.

8. A tufting machine according to claim 7, wherein the relief is in the form of a recess extending across the entire width of the knife adjacent to and below the cutting edge.

9. A tufting machine according to claim 1 wherein the upper hook has a tip which extends beyond the lower hook and extends downwardly to a location which is generally co-planar with the lower edge of the lower hook.

10. A tufting machine according to claim 1 wherein the tip of the upper hook is thinner than the remainder of the upper hook, with the thinning being applied to the surface on the knife side so that the tip of the upper hook is more closely aligned with the tip of the lower hook.

11. A tufting machine according to any one of claim 1 wherein the lower hook has a chamfer on its upper edge on the knife side to assist in creating the relief.

12. A tufting machine according to claim 1 further comprising a chamfer behind the cutting edge on the region of the upper hook against which the knife abuts, in use, to allow knife to transition from the lower hook to the upper hook.

13. A tufting machine according to claim 12, wherein the depth of the chamfer in the second direction increases away from the tip of the hook.

14. A tufting machine according to claim 1 wherein the knife has a reduced thickness at least along the section which, in use, will pass the hook assembly.

15. A tufting machine according to claim 1 wherein the point of the knife that abuts the hook assembly is flattened.

16. A tufting machine according to claim 1 wherein the means for selectively directing yarn onto one of the upper and lower hooks comprises a means for controlling the tension in the yarn and a resilient clip which co-operates with the lower hook to retain the loops of yarn on the lower yarn engaging portion until the tension is sufficiently increased so as to pull the yarn past the clip which deforms resiliently allowing the yarn onto the upper hook.

17. A hook assembly for a tufting machine according to claim 2 comprising upper and lower hooks each having a cutting edge at the lower edge and a means for selectively directing the yarn onto one of the upper and lower hooks, the cutting edges of upper and lower hooks being off-set with respect to one another so that the cutting edge of the upper hook projects beyond the cutting edge of the lower hook.

18. A knife for a cut pile tufting machine according to claim 8, the knife having a single cutting edge, the cutting edge being at one end, and a recess extending across the entire width of one side of the knife adjacent to and below the cutting edge.

19. A tufting machine for creating a cut pile carpet with two different pile heights, the machine comprising a housing;

a needle bar which is reciprocally movable within the housing and on which a plurality of needles are mounted, whereby, in use, as a web of backing medium is fed through the machine in a first direction, the plurality of needles reciprocate towards and away from the web in a second direction;

a hook assembly associated with each of the needles of said plurality of needles; each said hook assembly being reciprocally mounted so as to grab each loop of yarn as it is created by a respective needle; and a knife associated with each said hook assembly and having a cutting edge, each knife being reciprocally mounted and inclined with respect to the corresponding hook assembly so as to pressurize the knife against said respective hook assembly; wherein each said hook assembly is provided with an upper and a lower hook each having a cutting edge at a lower edge thereof and a means for controlling the tension in the yarn and a resilient clip which cooperates with the lower hook to retain the loops of yarn on the lower yarn engaging portion until the tension is sufficiently increased so as to pull the yarn past the clip which deforms resiliently allowing the yarn onto the upper hook;

each respective knife having a single cutting edge arranged to cooperate with both the upper hook and the lower hook to cut each loop of yarn seized by the respective hook assembly with a scissor action whether the loop is on the upper or lower hook; a relief being provided between the knife and the lower hook allowing the knife to clear the lower hook when the cutting edge of the knife approaches the cutting edge of the upper hook.

* * * * *